US009517574B2

(12) United States Patent
Yen

(10) Patent No.: US 9,517,574 B2
(45) Date of Patent: Dec. 13, 2016

(54) PUNCHING DEVICE

(71) Applicant: Chin-Wen Yen, Tainan (TW)

(72) Inventor: Chin-Wen Yen, Tainan (TW)

( * ) Notice: Subject to any disclaimer, the term of this patent is extended or adjusted under 35 U.S.C. 154(b) by 309 days.

(21) Appl. No.: 14/266,572

(22) Filed: Apr. 30, 2014

(65) Prior Publication Data

US 2014/0230624 A1 Aug. 21, 2014

Related U.S. Application Data

(63) Continuation-in-part of application No. 13/756,216, filed on Jan. 31, 2013, now abandoned.

(30) Foreign Application Priority Data

Jun. 22, 2012 (TW) ..... 101122458 A

(51) Int. Cl.
*B26D 5/10* (2006.01)
*B26F 1/36* (2006.01)
*B26F 1/44* (2006.01)

(52) U.S. Cl.
CPC . *B26D 5/10* (2013.01); *B26F 1/36* (2013.01); *B26F 2001/4418* (2013.01); *Y10T 83/8776* (2015.04)

(58) Field of Classification Search
CPC ..... B26D 5/00; B26D 5/10; B26F 1/36
USPC ..... 83/685
See application file for complete search history.

(56) References Cited

U.S. PATENT DOCUMENTS 4,713,995 A * 12/1987 Davi ..... B26F 1/36 83/167
4,757,733 A * 7/1988 Barlow ..... B26D 7/00 83/588
5,601,006 A * 2/1997 Quinn ..... B23D 35/008 83/588
5,749,278 A * 5/1998 Lee ..... B26F 1/36 83/588
5,819,647 A * 10/1998 Balosh ..... B44B 5/0085 101/31.1
6,089,137 A * 7/2000 Lee ..... B26F 1/04 30/358
6,428,248 B1 * 8/2002 Lee ..... B26F 1/04 407/117
6,752,058 B2 * 6/2004 Oh ..... B26D 3/10 30/358
6,938,542 B1 * 9/2005 Ho ..... B44B 5/0023 101/3.1
7,331,266 B2 * 2/2008 Chen ..... B26D 5/10 83/633
7,654,183 B2 * 2/2010 Marks ..... B26D 1/08 30/189

(Continued)

*Primary Examiner* — Jason Daniel Prone
*Assistant Examiner* — Richard Crosby, Jr.
(74) *Attorney, Agent, or Firm* — Christensen O'Connor Johnson Kindness PLLC

(57) ABSTRACT

A punching device includes: a die seat; a punch seat; an interconnecting member interconnecting the die seat and the punch seat; a punch; first and second pivot parts; a first lever pivoted to the first pivot part and having two first side walls and two side flanges that extend respectively from lower ends of the first side walls; a second lever pivoted to the second pivot part and having two second side walls that abut against the side flanges for driving rotation of the first lever relative to the first pivot part; and an urging member for urging the punch.

6 Claims, 15 Drawing Sheets

(56) References Cited

U.S. PATENT DOCUMENTS

| | | | | |
|---|---|---|---|---|
| 7,726,227 | B2 * | 6/2010 | Chan | B26F 1/36 83/685 |
| 7,971,513 | B2 * | 7/2011 | Chan | B26F 1/36 83/621 |
| 8,096,217 | B2 * | 1/2012 | Chan | B26D 7/00 83/167 |
| 8,347,770 | B2 * | 1/2013 | Cedar | B26D 5/10 83/634 |
| 8,635,936 | B2 * | 1/2014 | Lee | B26D 7/1818 83/125 |
| 8,763,503 | B1 * | 7/2014 | Hunter | B26F 1/32 83/167 |
| 9,108,333 | B2 * | 8/2015 | Lee | B26F 1/32 |
| 9,409,307 | B2 * | 8/2016 | Lee | B26D 5/08 |
| 2004/0231474 | A1 * | 11/2004 | Bier | A41B 3/06 83/13 |
| 2005/0039590 | A1 * | 2/2005 | Weng | B26F 1/36 83/684 |
| 2008/0168877 | A1 * | 7/2008 | Chan | B26F 1/14 83/685 |
| 2011/0030525 | A1 * | 2/2011 | Huang | B26D 5/10 83/620 |
| 2014/0190326 | A1 * | 7/2014 | Co | B26D 5/10 83/522.15 |

* cited by examiner

PUNCHING DEVICE

CROSS-REFERENCE TO RELATED APPLICATION

This application is a continuation-in-part (CIP) of co-pending U.S. patent application Ser. No. 13/756,216, filed on Jan. 31, 2013.

BACKGROUND OF THE INVENTION

1. Field of the Invention

This invention relates to a punching device, more particularly to a punching device including an interconnecting member that interconnects a die seat and a punch seat and a lever mechanism that is designed to reduce a torque applied to a corner between the interconnecting member and the punch seat during punching.

2. Description of the Related Art

FIG. 1 illustrates a conventional punching device 1, which is disclosed in U.S. Pat. No. RE38,219, for punching or embossing a sheet material to create a desired decorative shape for a decorative project, such as scrapbooking or other crafts. The conventional punching device 1 includes a die seat 111, a punch seat 112, an interconnecting member 113 interconnecting one end of the die seat 111 and one end of the punch seat 112, a punch 12 supported movably on the punch seat 112, a pivot part 117 extending upwardly from the other end 1121 of the punch seat 112, a lever 14 pivoted to the pivot part 117 and provided with a protrusion 143 that is in contact with a top end of the punch 12, and an urging member 13 for urging the punch 12 to move away from the die seat 111. The punch seat 112 is disposed above and cooperates with the die seat 111 to define a sheet-receiving gap 118 therebetween for receiving a paper sheet (not shown) to be punched. The die seat 111, the punch seat 112 and the interconnecting member 113 are in the form of a single piece of a rigid material, such as plastics or metal.

Since the walls of the single piece forming the die seat 111, the punch seat 112 and the interconnecting member 113 are relatively thin, which reduces the cost and weight of the punching device 1, the interconnecting member 113 and a corner 115 between the punch seat 112 and the interconnecting member 113 tend to deform or be damaged after a period of use. The problem is attributed to the generation of a counter force (F) that acts on the pivot part 117 and is transmitted to the other end 1121 of the punch seat 112 when the lever 14 is pressed downward. The counter force (F) creates a torque (T), which is the product of the counter force (F) and a horizontal distance between the interconnecting member 113 and the other end 1121 of the punch seat 112, applied to the interconnecting member 113 and the corner 115 during the punching operation.

SUMMARY OF THE INVENTION

Therefore, an object of the present invention is to provide a punching device with a lever mechanism that can reduce the torque applied to the interconnecting member and the corner between the interconnecting member and the punch seat of the punching device during punching, thereby preventing deformation or damage to the interconnecting member and the corner.

According to the present invention, there is provided a punching device that comprises: a die seat having first and second end portions that are opposite to each other in an insertion direction; a punch seat disposed above the die seat and having opposite first and second end portions that are respectively disposed adjacent to the first and second end portions of the die seat, the punch seat and the die seat cooperatively defining a sheet-receiving gap therebetween; an interconnecting member interconnecting the first end portion of the die seat and the first end portion of the punch seat and confining one side of the sheet-receiving gap; a punch disposed movably on the punch seat so as to be movable relative to the die seat in a vertical direction that is perpendicular to the insertion direction; a first pivot part extending from at least one of the first end portion of the die seat and the first end portion of the punch seat; a second pivot part opposite to the first pivot part in the insertion direction and extending from one of the second end portion of the punch seat and the second end portion of the die seat; a lever mechanism including first and second levers, the first lever having opposite first and second ends, a top wall that extends from the first end of the first lever to the second end of the first lever, two first side walls that respectively have lower ends and that extend downwardly and respectively from two opposite sides of the top wall to the lower ends, two side flanges that extend respectively from the lower ends of the first side walls away from each other, and a protrusion that is disposed between and that is spaced apart from the first side walls, that protrudes downwardly from the top wall of the first lever and that abuts against the punch, the first end of the first lever being pivoted to the first pivot part, the first side walls being opposite to each other in a transverse direction that is perpendicular to the insertion direction and the vertical direction, the top wall covering a top side of the punch and spanning the punch in the transverse direction, the second lever having opposite first and second ends, a top wall that extends from the first end of the second lever to the second end of the second lever, and two second side walls that extend downwardly and respectively from two opposite sides of the top wall of the second lever and that abut respectively against the side flanges for driving rotation of the first lever relative to the first pivot part, the second end of the second lever being pivoted to the second pivot part; and an urging member for urging the punch.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
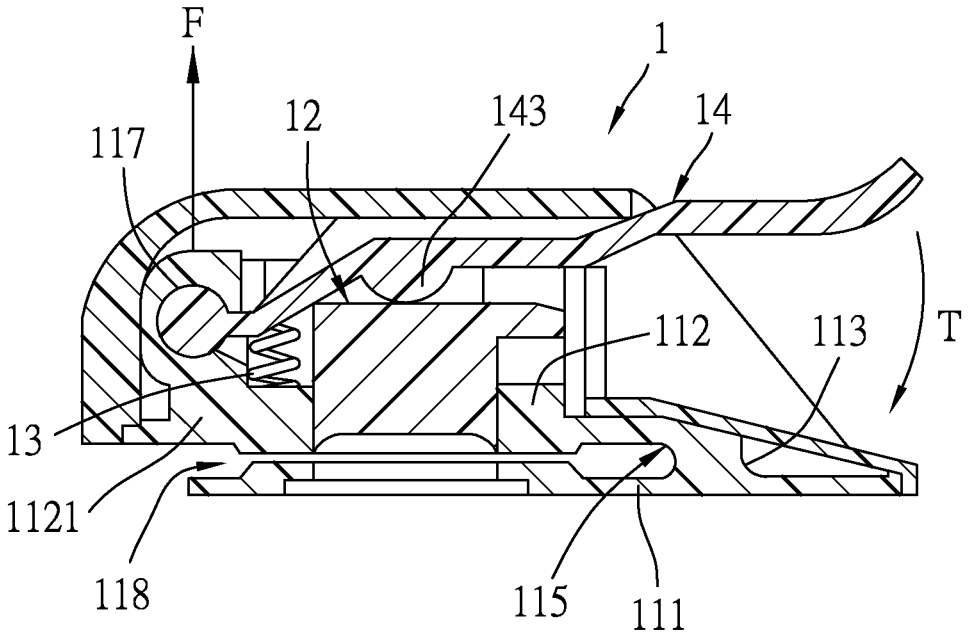
FIG. 1 PRIOR ART
FIG. 1 is a sectional view of a conventional punching device.
Figure 2:
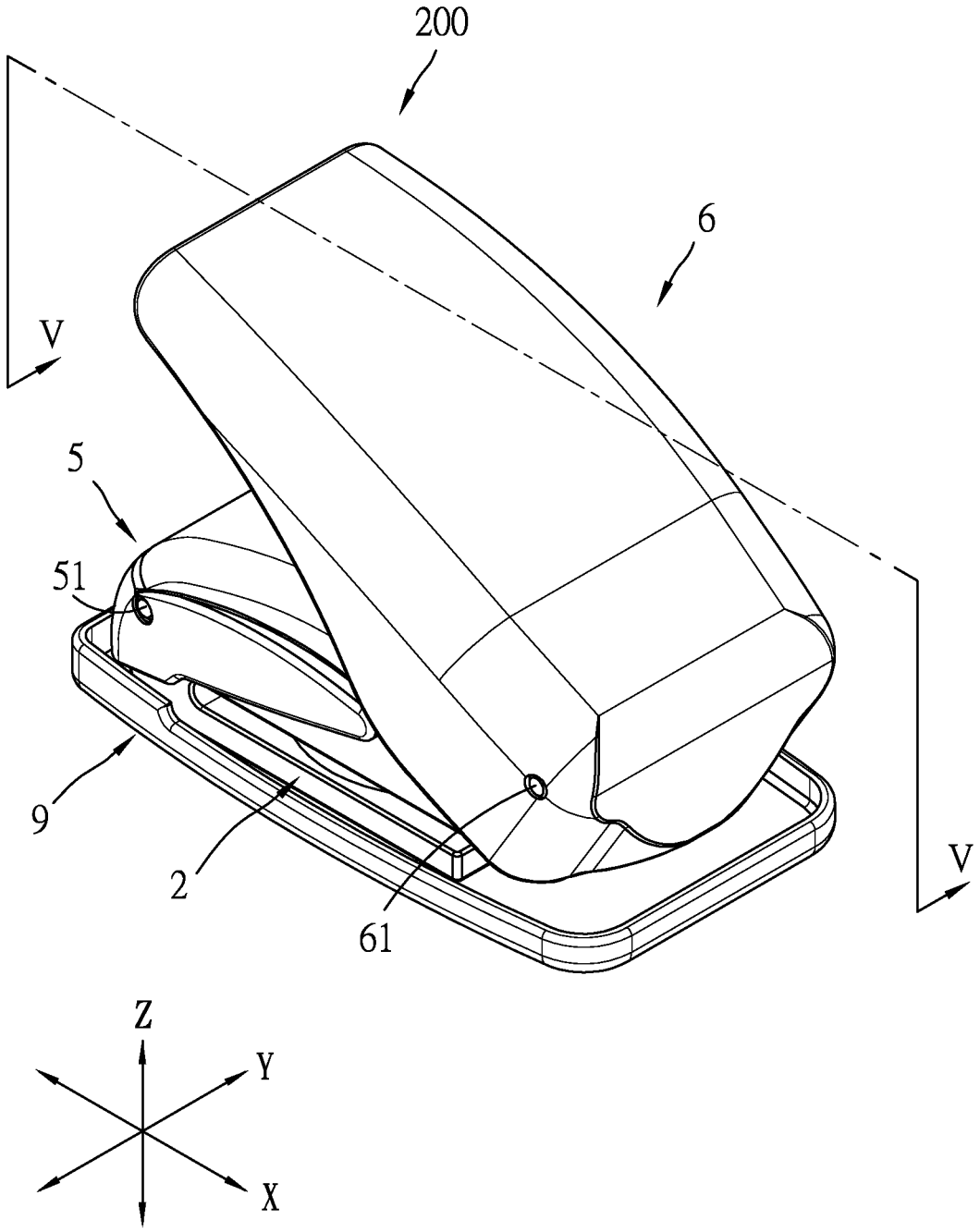
FIG. 2 is a perspective view of the first preferred embodiment of a punching device according to the present invention.
Figure 3:
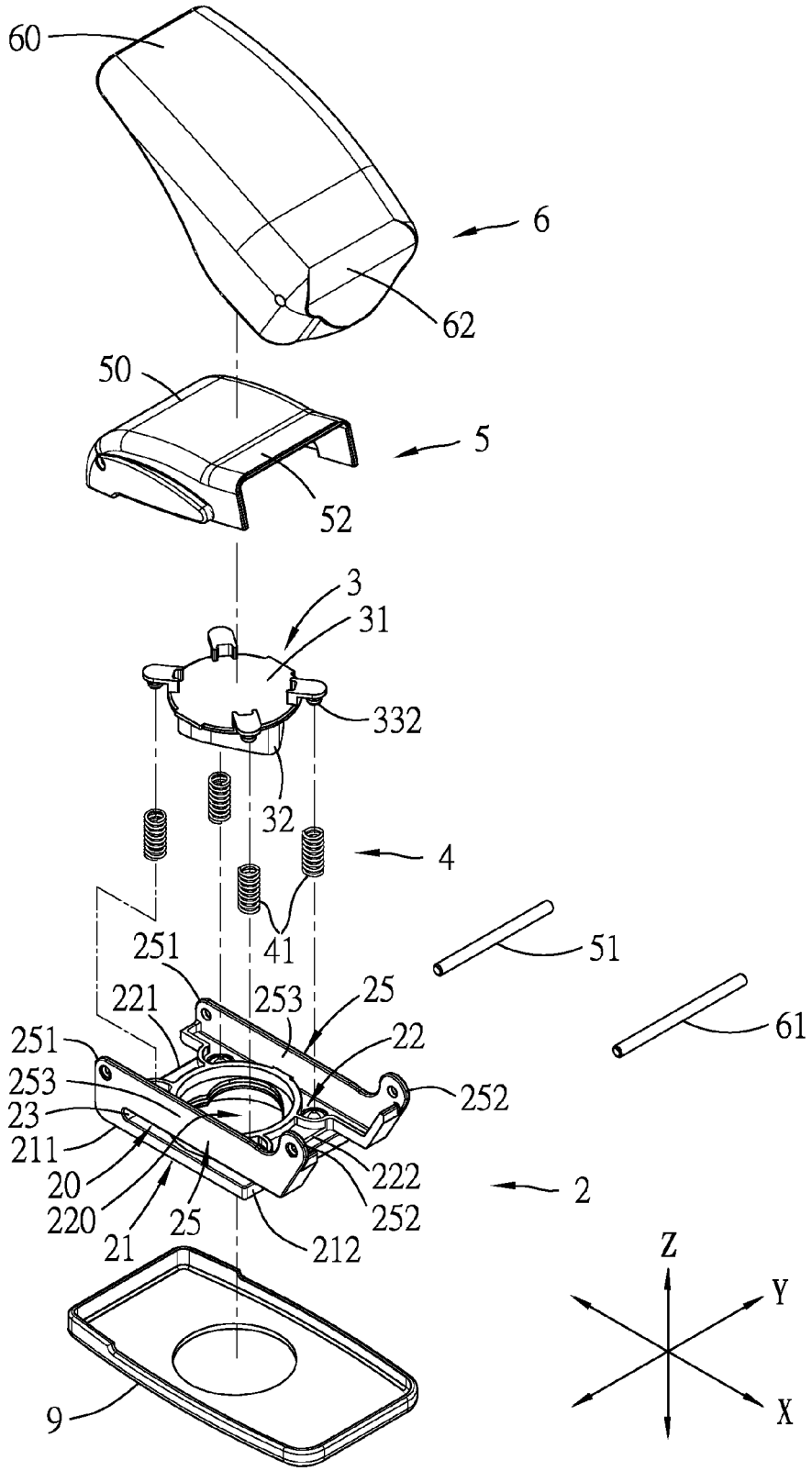
FIG. 3 is an exploded perspective top view of the first preferred embodiment.
Figure 4:
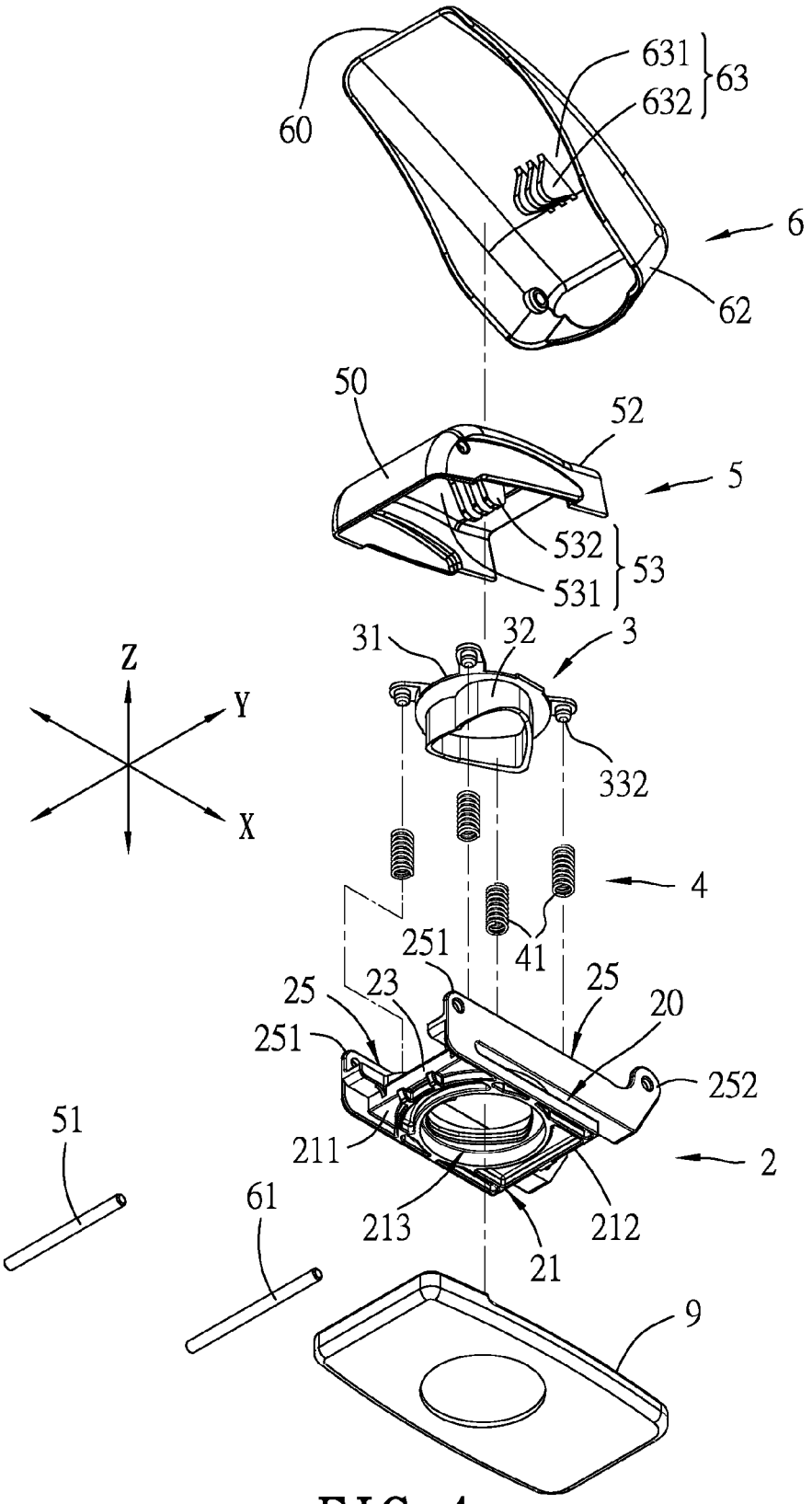
FIG. 4 is an exploded perspective bottom view of the first preferred embodiment.
Figure 5:
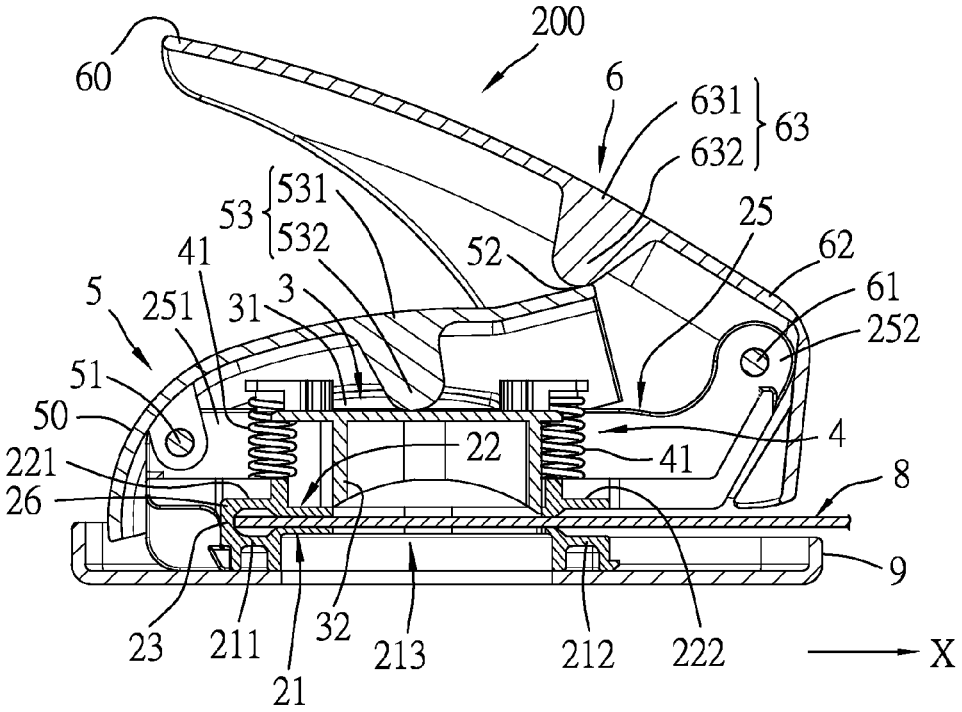
FIG. 5 is a sectional view taken along line V-V of FIG. 2.
Figure 6:
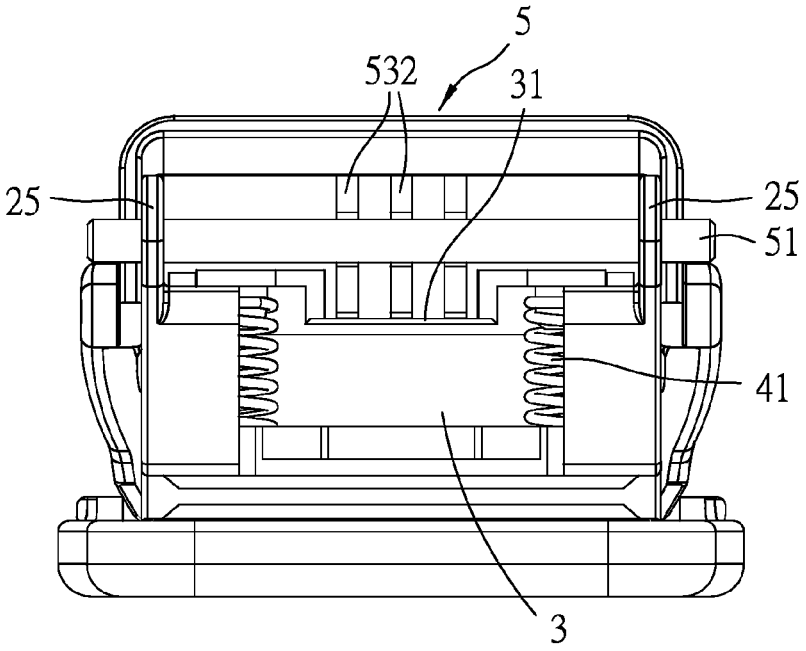
FIG. 6 is a side view of the first preferred embodiment (a second lever is not shown for showing an inside of the punching device)
Figure 7:
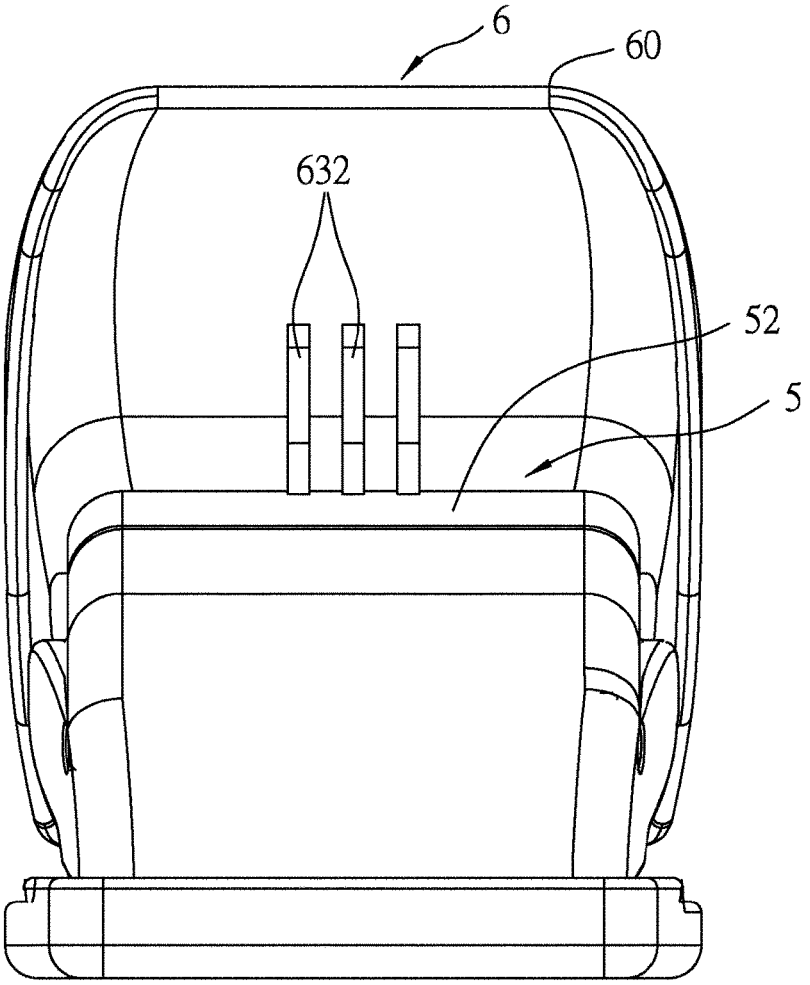
FIG. 7 is another side view of the first preferred embodiment.

Before the present invention is described in greater detail with reference to the accompanying preferred embodiments, it should be noted herein that like elements are denoted by the same reference numerals throughout the disclosure.

FIGS. 2 to 7 illustrate the first preferred embodiment of a punching device 200 according to the present invention. The punching device 200 may be used to cut or emboss a sheet 8 (see FIGS. 5 and 8) of a material, such as paper or plastics, so as to form a desired pattern for the material.

The punching device 200 includes a bottom cover 9, a main support 2, a punch 3, an urging unit 4, and a lever mechanism.

The main support 2 includes a die seat 21, a punch seat 22, an interconnecting member 23 and a pair of pivot-linking plates 25. The die seat 21 extends into and releasably engages the bottom cover 9, has opposite first and second end portions 211, 212, and is formed with a die hole 213 disposed between the first and second end portions 211, 212. The first and second end portions 211, 212 are opposite to each other in an insertion direction (X).

The punch seat 22 is disposed above the die seat 21 and has opposite first and second end portions 221, 222 that are respectively disposed adjacent to the first and second end portions 211, 212 of the die seat 21. The punch seat 22 and the die seat 21 cooperatively define a sheet-receiving gap 20 therebetween for receiving the sheet 8. The interconnecting member 23 is disposed between and interconnects the first end portion 211 of the die seat 21 and the first end portion 221 of the punch seat 22 and confines one side of the sheet-receiving gap 20 to stop further advancement of the sheet 8 in the insertion direction (X). The interconnecting member 23 and the first end portion 221 of the punch seat 22 cooperatively define a first corner 26 therebetween. The pivot-linking plates 25 are transverse to the punch seat 22, are disposed opposite to each other in a transverse direction (Y) perpendicular to the insertion direction (X), and are connected to two opposite sides of the punch seat 22, respectively. Each of the pivot-linking plates 25 has a first pivot part 251, a second pivot part 252 opposite to the first pivot part 251 in the insertion direction (X), and a middle part 253 interconnecting the first and second pivot parts 251, 252. The first pivot parts 251 of the pivot-linking plates 25 extend from the first end portion 211 of the die seat 21 and the first end portion 221 of the punch seat 22. Alternatively, the first pivot parts 251 of the pivot-linking plates 25 can extend from one of the first end portion 211 of the die seat 21 and the first end portion 221 of the punch seat 22. The second pivot parts 252 of the pivot-linking plates 25 extend upwardly from the second end portion 222 of the punch seat 22.

In this embodiment, the main support 2 is in the form of a single piece of a rigid material, such as plastics or metal, and the interconnecting member 23 has a vertically extending plate. Alternatively, the interconnecting member 23 can be in the form of a set of magnets (not shown) secured to the die seat 21 and the punch seat 22.

The punch 3 is supported movably on the punch seat 22 so as to be movable relative to the die seat 21 into the die hole 213 in a vertical direction (Z) that is perpendicular to the insertion direction (X) and the transverse direction (Y), and has a top wall 31 that is provided with a plurality of studs 332, and a blade 32 extending downwardly from the top wall 31. The punch 3 is movable relative to the die seat 21 in the vertical direction (Z) between an initial position (a non-punched position, see FIG. 5) and a punched position (see FIG. 8).

The urging unit 4 includes a plurality of coil springs 41 respectively mounted to and abutting against the studs 332 and the punch seat 22 for urging the punch 3 to move back to the non-punched position. Alternatively, the urging unit 4 can be in the form of a single coil spring (not shown) surrounding the punch 3.

The lever mechanism includes first and second levers 5, 6 that are stacked one above the other. The first lever 5 has opposite first and second ends 50, 52, and a contact portion 53 that is disposed between the first and second ends 50, 52 of the first lever 5 and that contacts the punch 3 for pressing the punch 3. The first end 50 of the first lever 5 is pivoted to the first pivot parts 251 about a first pivot shaft 51. In this embodiment, the first pivot shaft 51 is disposed above and adjacent to the interconnecting member 23. The contact portion 53 of the first lever 5 has a middle part 531 interconnecting the first and second ends 50, 52 of the first lever 5 and a protrusion 532 protruding from the middle part 531 toward and in contact with the punch 3.

The second lever 6 has opposite first and second ends 60, 62, and a contact portion 63 that is disposed between the first and second ends 60, 62 of the second lever 6 and that contacts the second end 52 of the first lever 5 for pressing the second end 52 of the first lever 5. The second end 62 of the second lever 6 is pivoted to the second pivot parts 252 about a second pivot shaft 61. The interconnecting member 23 is disposed between the first and second pivot shafts 51, 61 when viewed in the vertical direction (Z). The contact portion 63 of the second lever 6 has a middle part 631 interconnecting the first and second ends 60, 62 of the second lever 6 and a protrusion 632 protruding from the middle part 631 of the contact portion 63 of the second lever 6 toward and in contact with the second end 52 of the first lever 5.

The punch seat 22 is formed with a central hole 220 for extension of the blade 32 of the punch 3 therethrough. The central hole 220 is disposed between the first and second end portions 221, 222 of the punch seat 22.

The first lever 5 is rotatable relative to the punch seat 22 about a first axis of the first pivot shaft 51. The second lever 6 is rotatable relative to the punch seat 22 about a second axis of the second pivot shaft 61. The second axis is parallel to the first axis, and is disposed at a level above the first axis.

Figure 8:
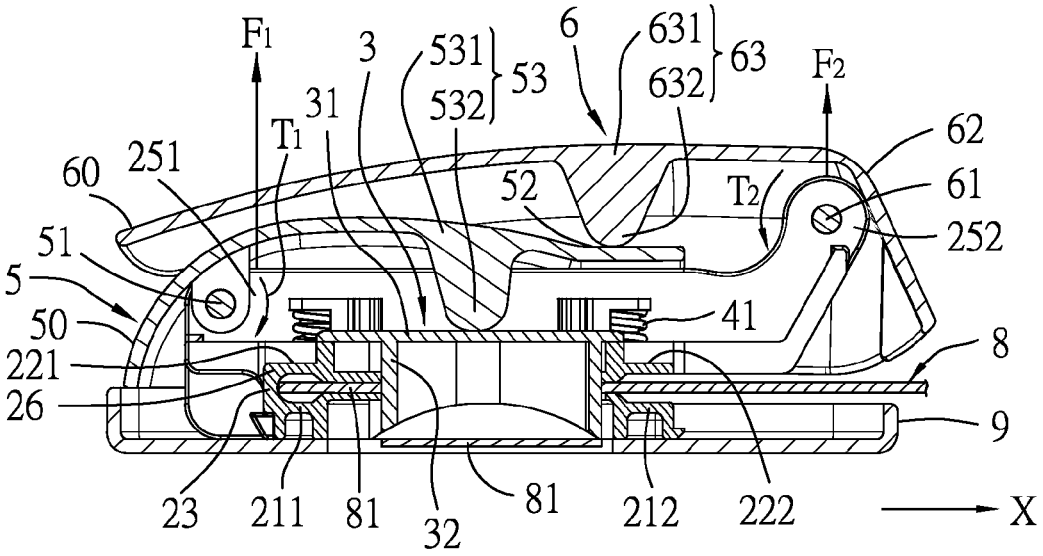
FIG. 8 is a sectional view illustrating a punching state of the first preferred embodiment.

Referring to FIG. 8, in operation, the first end 60 of the second lever 6 is pressed downward to press the second end 52 of the first lever 5, which drives the punch 3 to move downward into the die hole 213 (see FIG. 5) and to cut the sheet 8 into different pieces 81. During the punching operation, a first counter force ($F_1$), which acts on the first pivot parts 251 (only one is seen) and is transmitted to the first end portion 221 of the punch seat 22, and a second counter force ($F_2$), which acts on the second pivot parts 252 (only one is seen) and is transmitted to the second end portion 222 of the punch seat 22, are generated. The first counter force ($F_1$) creates a first torque ($T_1$), which is the product of the first counter force ($F_1$) and a horizontal distance in the insertion direction (X) between the first axis and the interconnecting member 23, applied to the interconnecting member 23 and the first corner 26. Since the first pivot shaft 51 is disposed adjacent to the interconnecting member 23, the horizontal distance between the first axis and the interconnecting member 23 is small, i.e., the first torque ($T_1$) is small, too. Hence, the first torque ($T_1$) will not cause deformation or damage to the interconnecting member 23 and the first corner 26. The second counter force ($F_2$) creates a second torque ($T_2$), which is the product of the second counter force ($F_2$) and the horizontal distance between the second axis and the interconnecting member 23, applied to the interconnecting member 23 and the first corner 26. According to the lever principle, the force output from the protrusion 632 is much less than that from the protrusion 532, i.e., the second counter force ($F_2$) is considerably reduced as compared to the counter force (F) of the prior art shown in FIG. 1. As such, the second toque ($T_2$) is much less than the torque (T) of the prior art, thereby preventing deformation or damage to the interconnecting member 23 and the first corner 26 when the interconnecting member 23 is in the form of a vertical plate and also preventing undesired disconnection between the punch seat 22 and the die seat 21 when the interconnecting member 23 is in the form of a set of magnets connected to the punch seat 22 and the die seat 21.

Figure 9:
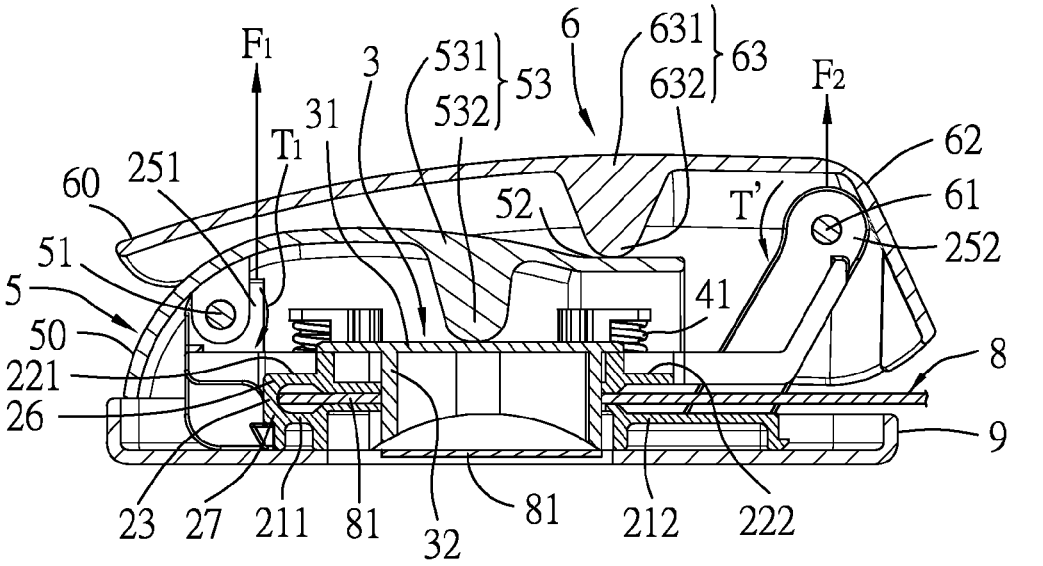
FIG. 9 is a sectional view of the second preferred embodiment of the punching device according to the present invention.

FIG. 9 illustrates the second preferred embodiment of the punching device 200 according to the present invention. The second preferred embodiment differs from the previous embodiment in that the second pivot parts 252 (only one is seen) extend upwardly from the second end portion 212 of the die seat 21. As such, the second counter force ($F_2$) acts on the second pivot parts 252 and is transmitted to the second end portion 212 of the die seat 21, and the resulting second torque (T') is applied to the interconnecting member 23 and a second corner 27 between the interconnecting member 23 and the first end portion 211 of the die seat 21. Similar to the previous embodiment, the second torque (T') is considerably reduced as compared to the torque (T) of the prior art.

Figure 10:
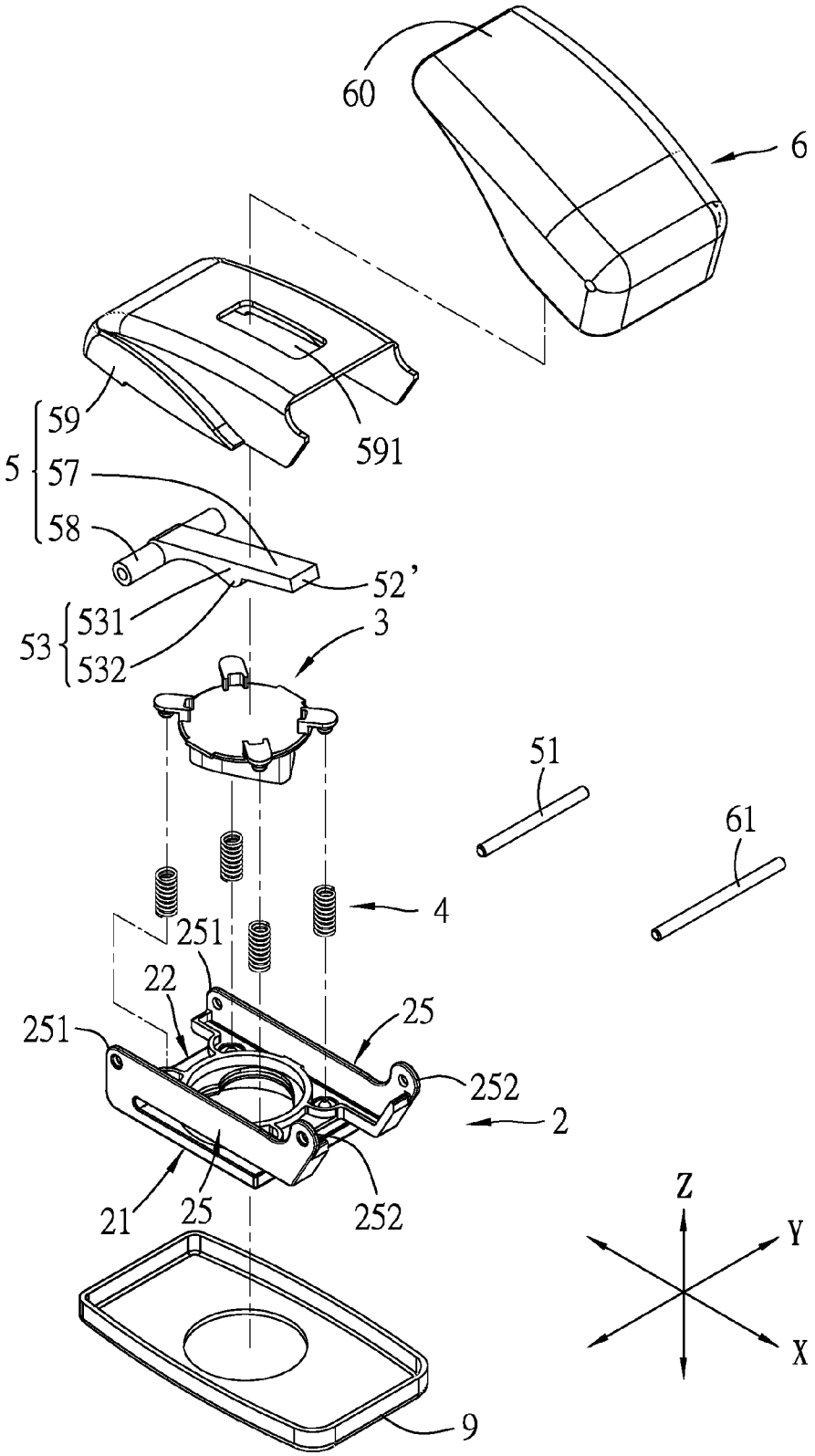
FIG. 10 is an exploded perspective view of the third preferred embodiment of the punching device according to the present invention.
Figure 11:
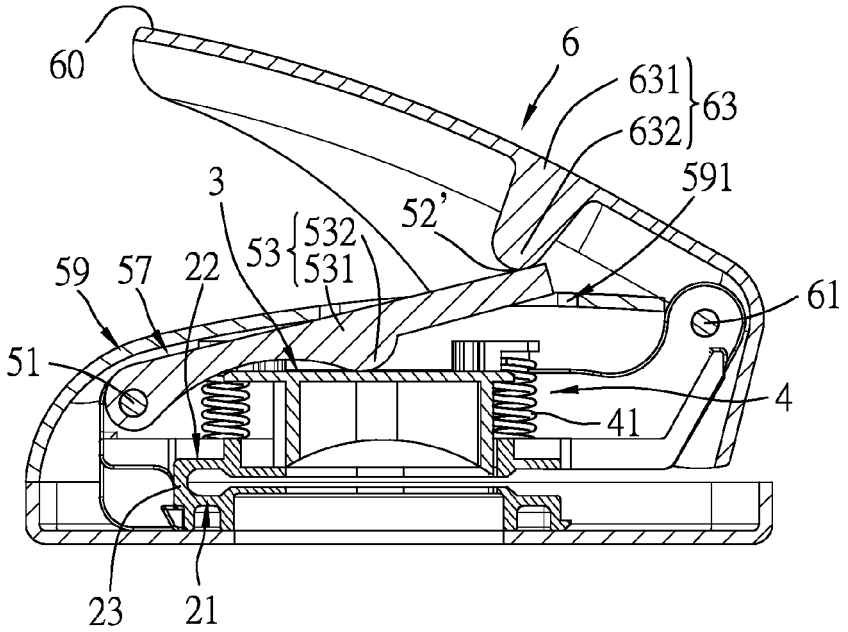
FIG. 11 is a sectional view of the third preferred embodiment.

FIGS. 10 and 11 illustrate the third preferred embodiment of the punching device 200 according to the present invention. The third preferred embodiment differs from the first preferred embodiment in the structure of the first lever 5. In this embodiment, the first lever 5 includes a shaft sleeve 58 for extension of the first pivot shaft 51 therethrough, a lever arm portion 57 and an inner cover portion 59. The lever arm portion 57 is integrally formed with the shaft sleeve 58 so as to be pivoted to the first end portion 221 of the punch seat 22 about the first pivot shaft 51, and has a free end 52'. The inner cover portion 59 is mounted to the die seat 21, covers the punch 3 and a segment of the lever arm portion 57, and is formed with a top window 591. The free end 52' of the lever arm portion 57 extends through the top window 591 and defines the second end 52 of the first lever 5.

Figure 12:
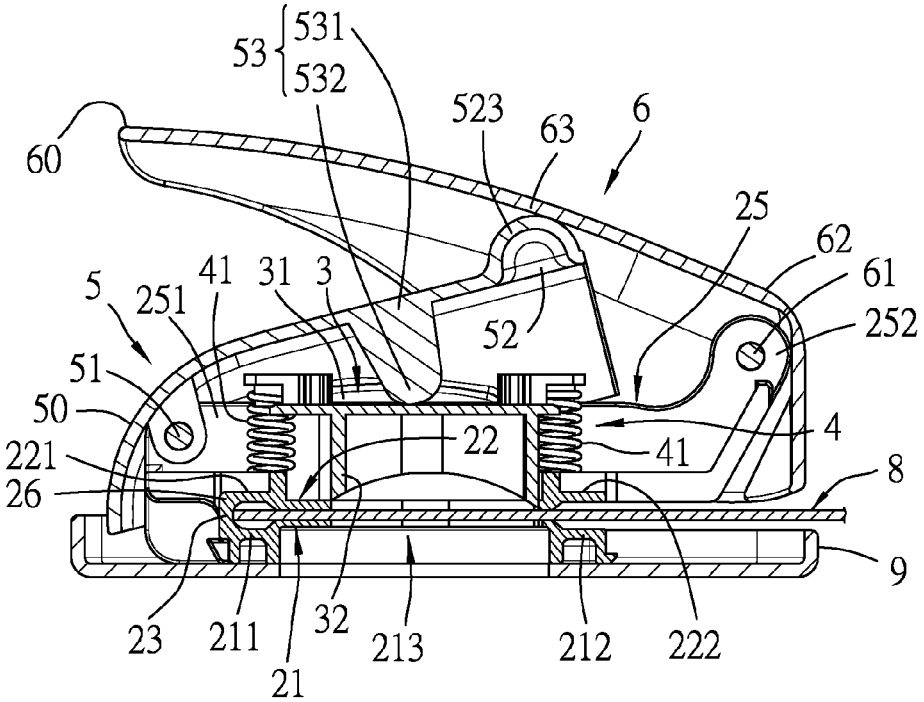
FIG. 12 is a sectional view of the fourth preferred embodiment of the punching device according to the present invention.
Figure 13:
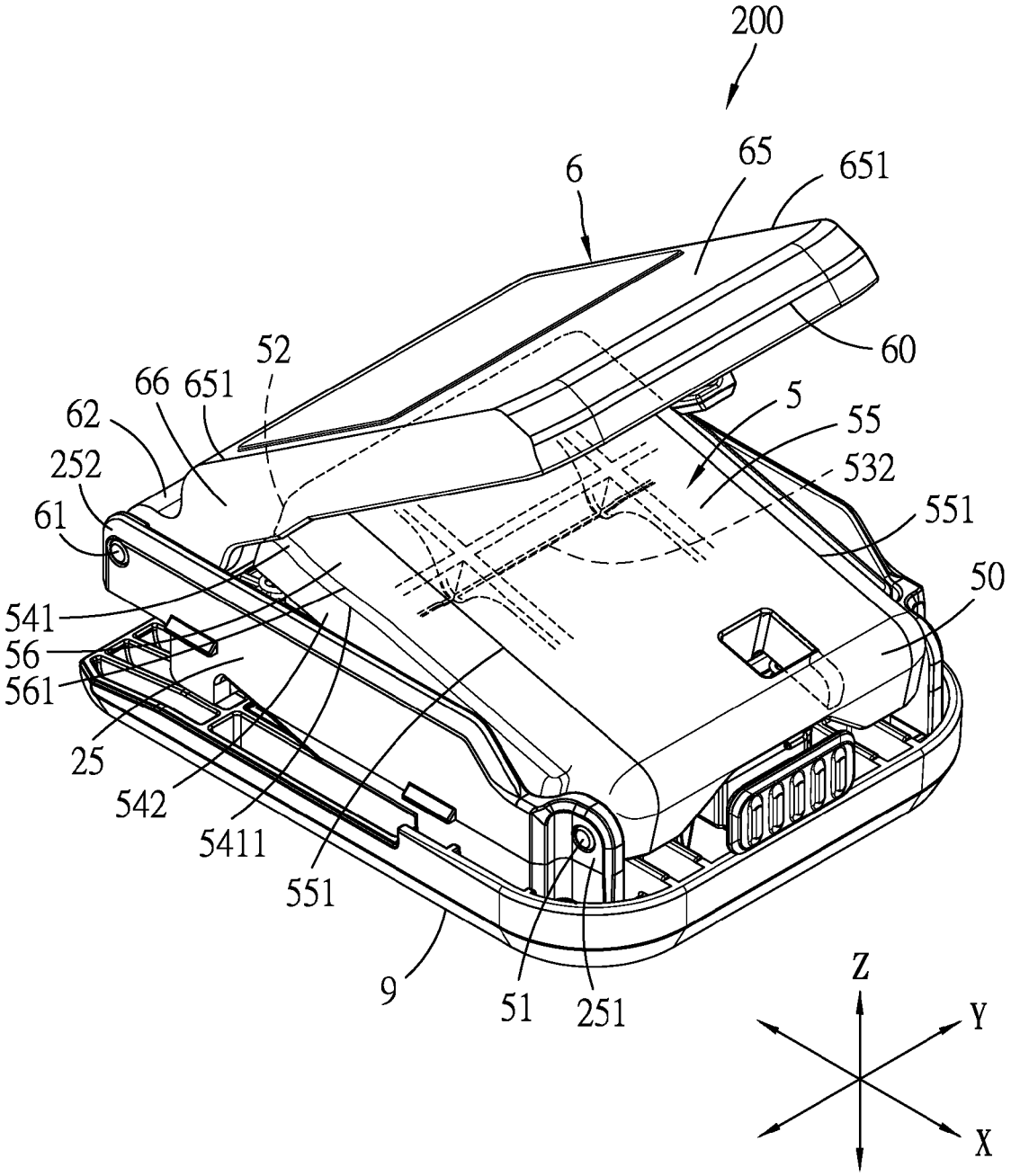
FIG. 13 is a perspective view of the fifth preferred embodiment of the punching device according to the present invention.
Figure 14:
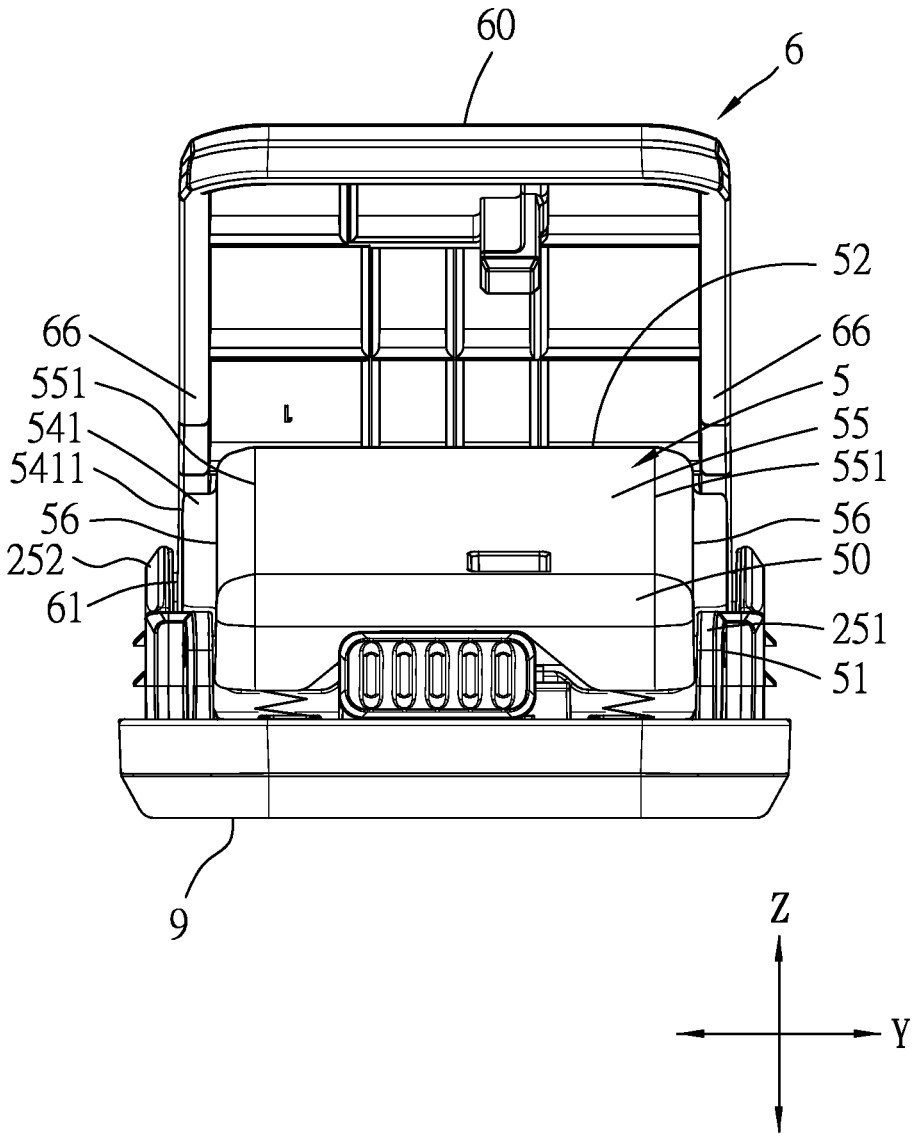
FIG. 14 is a side view of the fifth preferred embodiment.
Figure 15:
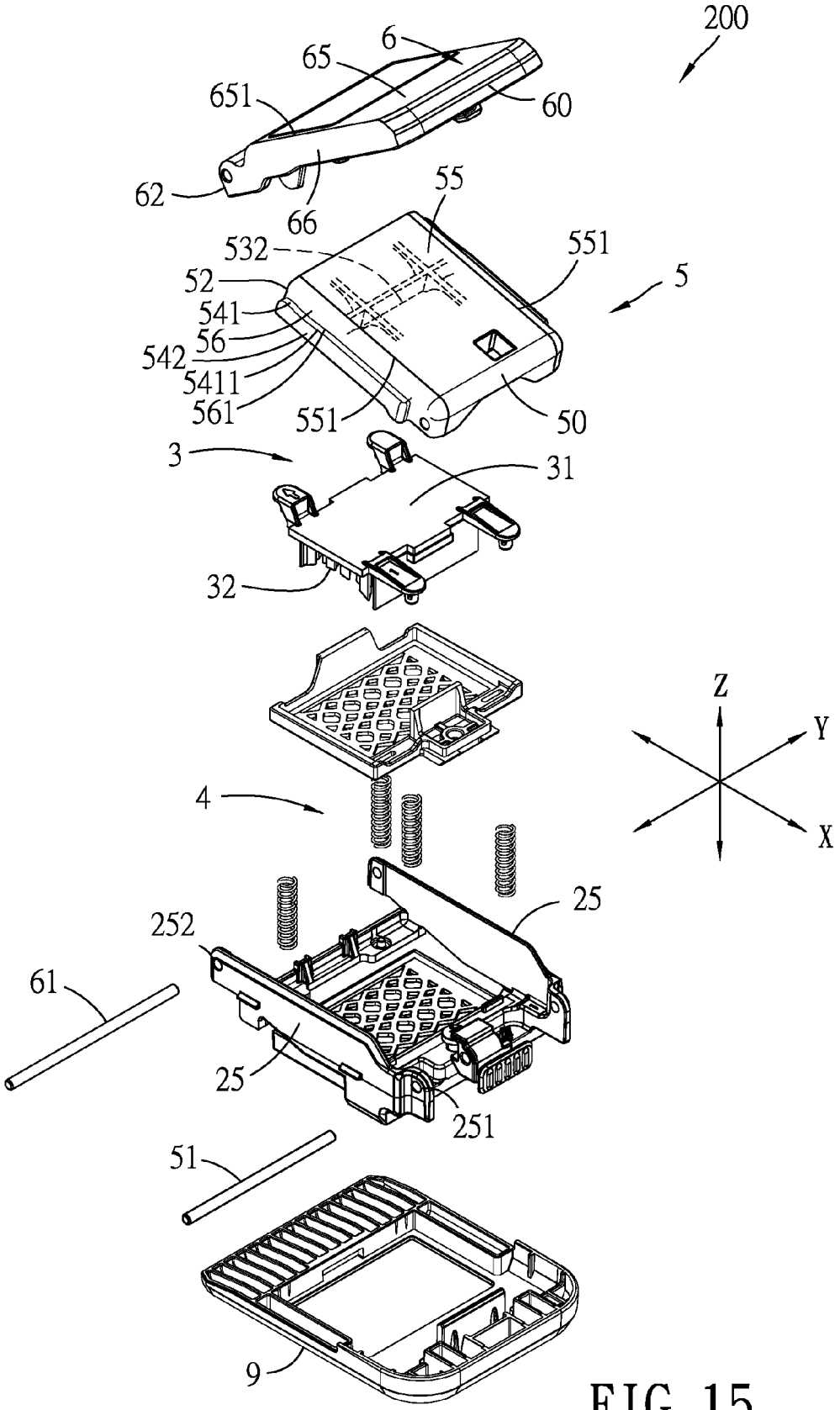
FIG. 15 is an exploded perspective view of the fifth preferred embodiment.

FIG. 12 illustrates the fourth preferred embodiment of the punching device 200 according to the present invention. The fourth preferred embodiment differs from the first preferred embodiment in that the second lever 6 has no protrusion formed on the contact portion 63 of the second lever 6, that the contact portion 53 of the first lever 5 has a first protrusion 532 protruding from the middle part 531 toward and in contact with the punch 3, and that the second end portion 52 of the first lever 5 is formed with a second protrusion 523 protruding therefrom toward and in contact with the contact portion 63 of the second lever 6.

FIGS. 13 to 17 illustrate the fifth preferred embodiment of the punching device 200 according to the present invention. The fifth preferred embodiment differs from the previous embodiments in the structures of the first and second levers 5, 6.

In this embodiment, the first lever 5 has opposite first and second ends 50, 52 that are opposite to each other in the insertion direction (X), a top wall 55 that extends from the first end 50 of the first lever 5 to the second end 52 of the first lever 5, two first side walls 56 that respectively have lower ends 561 (only one is shown) and that extend downwardly and respectively from two opposite sides 551 of the top wall 55 to the lower ends 561, two side flanges 541 that extend respectively from the lower ends 561 of the first side walls 56 away from each other, and a protrusion 532 that is disposed between and that is spaced apart from the first side walls 56, that protrudes downwardly from the top wall 55 of the first lever 5 and that abuts against the top wall 31 of the punch 3 for driving movement of the punch 3 along the vertical direction (Z). The first side walls 56 are opposite to each other in the transverse direction (Y). In this embodiment, the length of the side flanges 541 extends from the second end 52 toward the first end 50 of the first lever 5. Alternatively, the length of the side flanges 541 can be shorter as long as the mechanical strength thereof is sufficient to withstand the force acted thereon during punching.

Figure 16:
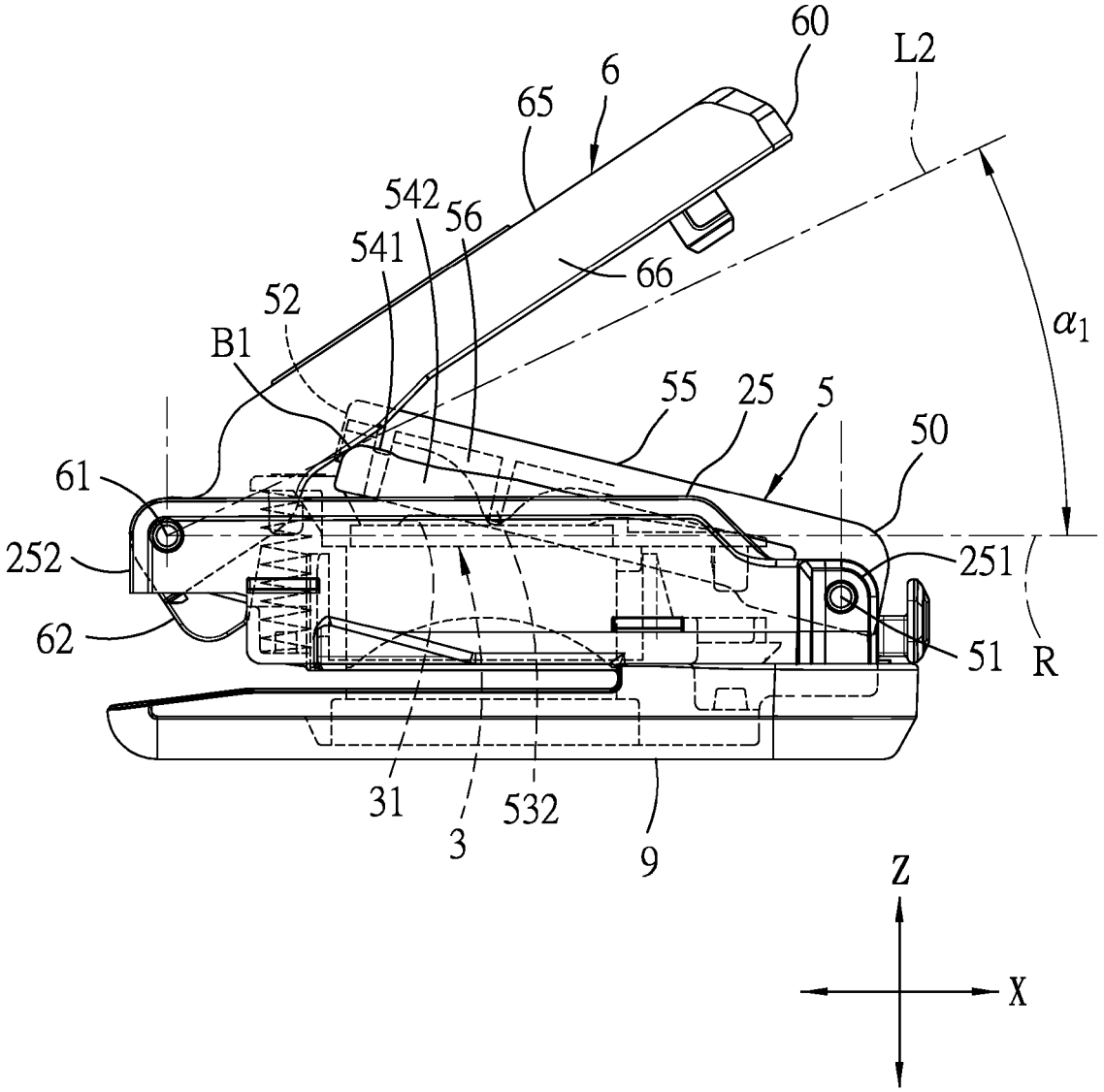
FIG. 16 is a side view illustrating a state where a lever of the fifth preferred embodiment is disposed at a non-pressed position.
Figure 17:
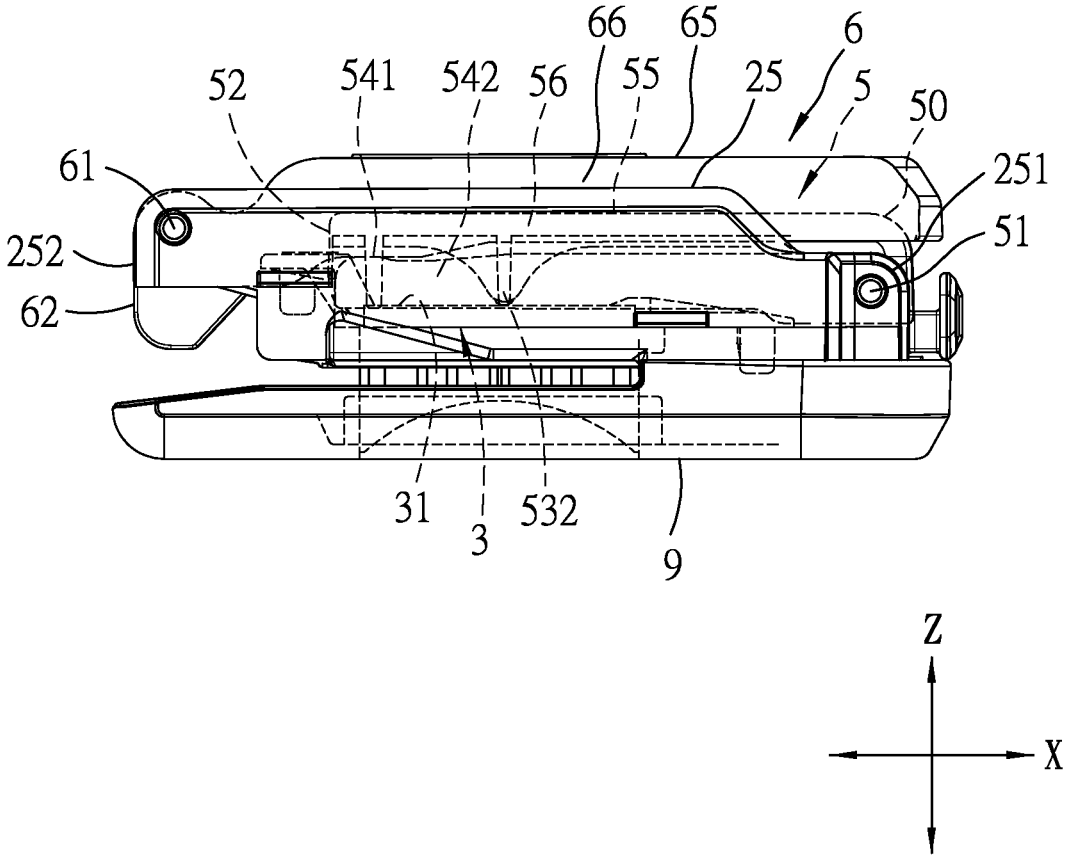
FIG. 17 is a side view illustrating another state where the lever of the fifth preferred embodiment is disposed at a pressed position.

The second lever 6 has opposite first and second ends 60, 62, a top wall 65 that extends from the first end 60 of the second lever 6 to the second end 62 of the second lever 6, and two second side walls 66 that extend downwardly and respectively from two opposite sides 651 of the top wall 65 of the second lever 6 and that abut respectively against the side flanges 541 for driving rotation of the first lever 5 relative to the first pivot parts 251 about the first axis of the first pivot shaft 51 when the second lever 6 is rotated relative to the second pivot parts 252 about the second axis of the second pivot shaft 61 from a non-pressed position (see FIG. 16) to a pressed position (see FIG. 17). The second side walls 66 of the second lever 6 have a height in the vertical direction (Z) and a thickness in the transverse direction (Y) that permit the second side walls 66 to have sufficient mechanical strength for enduring a compression force acted thereon by the side flanges 541 during a punching operation.

Each of the side flanges 541 has an outer end 5411, extends from the lower end 561 of the respective one of the first side walls 56 to the outer end 5411 in the transverse direction (Y), and cooperates with the respective one of the first side walls 56 to form a generally L-shaped structure that extends downwardly from the top wall 55 of the first lever 5.

The first lever 5 further has two reinforcing walls 542 (only one is shown) that extend downwardly and respectively from the outer ends 5411 of the side flanges 541 so as to cooperate with the side flanges 541 to form two generally L-shaped structures that can enhance the mechanical strength of the side flanges 541 for enduring a counter force acted thereon by the second side walls 66 during the punching operation.

The top wall 55 of the first lever 5 covers a top side of the punch 3, and spans the punch 3 in the transverse direction (Y) so that the side flanges 541 can be positioned at a lower position relative to the top wall 55 of the first lever 5 along the vertical direction (Z) without interfering with the punch 3 and so that the reinforcing walls 542 can extend downwardly from the side flanges 541 in the vertical direction (Z) beyond the top side of the punch 3 without interfering with the punch 3.

Figure 18:
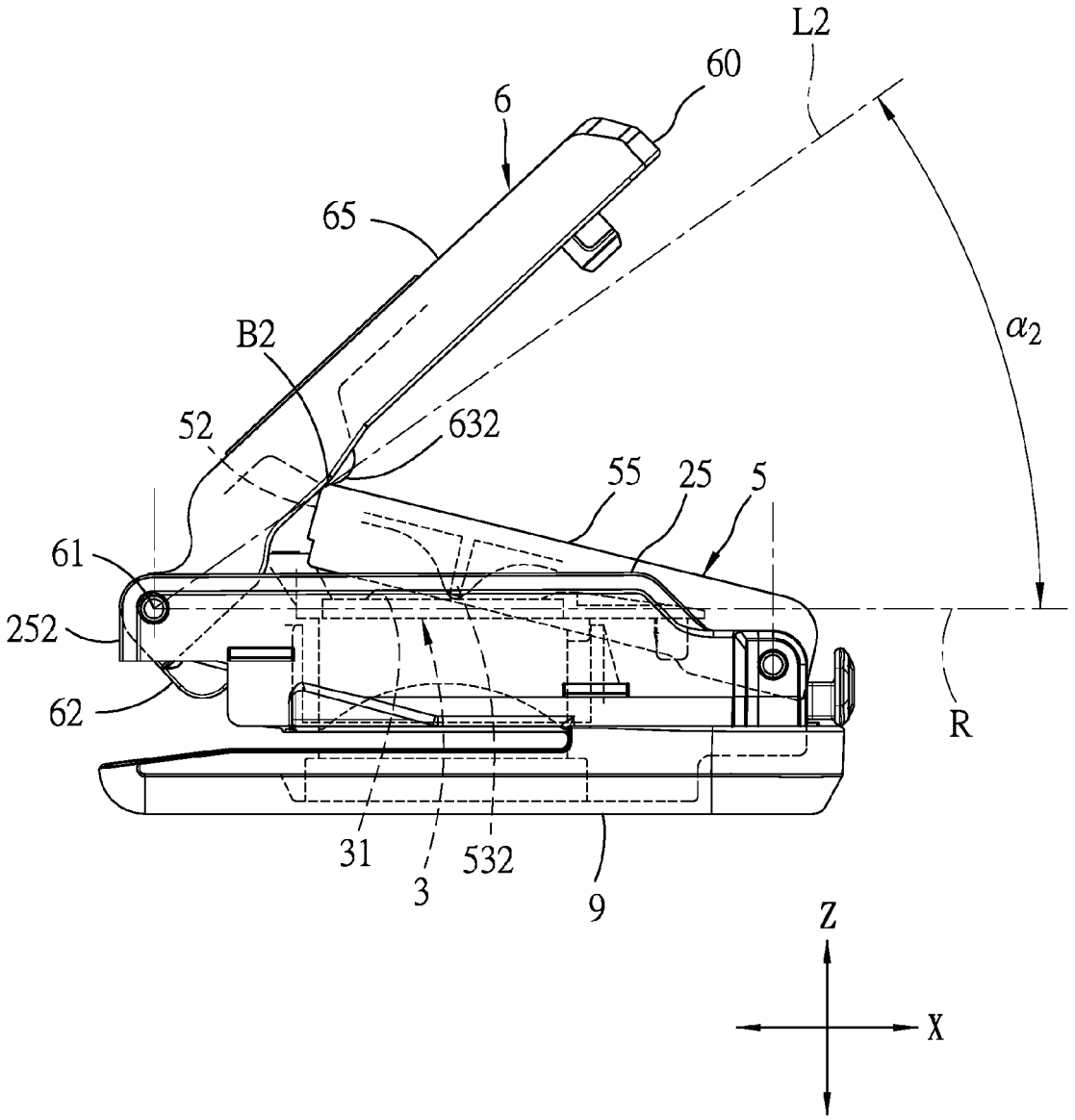
FIG. 18 is a schematic view illustrating a state where the lever of an embodiment modified from the fifth preferred embodiment is disposed at the non-pressed position.

The advantages of the first and second levers 5, 6 of the fifth preferred embodiment over those of the previous preferred embodiments can be better illustrated as follows with reference to FIGS. 16 and 18. In FIG. 16, the second lever 6 is disposed at a first angle ($\alpha_1$) defined by a first contact line (L1) and a horizontal reference plane (R). The first contact line (L1) is perpendicular to the second axis of the second pivot shaft 61 and passes through the second axis and a contact point (B1) between one of the second side walls 66 (only one is seen) and a corresponding one of the side flanges 541 (only one is seen). The horizontal reference plane (R) passes through the second axis and is perpendicular to the vertical direction (Z). In FIG. 18 (with the second protrusion 632 pressing against the first lever 5 as designed in the previous embodiments), the second lever 6 is disposed at a second angle ($\alpha_2$) defined by a second contact line (L2) and the horizontal reference plane (R). The second contact line (L2) is perpendicular to the second axis, and passes through the second axis and a contact point (B2) between the second protrusion 632 and the top wall 55 of the first lever 5. It is noted that the second protrusion 632 is required to have a thickness along the vertical direction (Z) that is sufficient to provide satisfactory mechanical strength for performing the punching operation without causing deformation thereof. As a consequence, in the previous embodiments, the second angle ($\alpha_2$) may be too large due to the second protrusion 632, such that the second lever 6 is too steep for the user to operate, thereby causing difficulty and inconvenience in operation. Hence, by disposing the side flanges 541 (see FIG. 14) at a position lower than the top wall 55 of the first lever 5 along the vertical direction (Z), the angle of the second lever 6 with respect to the horizontal reference plane (R) can be reduced from the second angle ($\alpha_2$) to the first angle ($\alpha_1$) and the steepness of the second lever 6 and the height of the first end 60 of the second lever 6 relative to the die seat 21 can be lowered when the second lever 6 is disposed at the non-pressed position.

While the present invention has been described in connection with that are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A punching device comprising:

a die seat having first and second end portions that are opposite to each other in an insertion direction;

a punch seat disposed above said die seat and having opposite first and second end portions that are respectively disposed adjacent to said first and second end portions of said die seat, said punch seat and said die seat cooperatively defining a sheet-receiving gap therebetween;

an interconnecting member interconnecting said first end portion of said die seat and said first end portion of said punch seat and confining one side of said sheet-receiving gap;

a punch disposed movably on said punch seat so as to be movable relative to said die seat in a vertical direction that is perpendicular to the insertion direction;

a first pivot part extending from at least one of said first end portion of said die seat and said first end portion of said punch seat;

a second pivot part opposite to said first pivot part in the insertion direction and extending from one of said second end portion of said punch seat and said second end portion of said die seat;

a lever mechanism including first and second levers, said first lever having opposite first and second ends, a top wall that extends from said first end of said first lever to said second end of said first lever, two first side walls that respectively have lower ends and that extend downwardly and respectively from two opposite sides of said top wall to said lower ends, two side flanges that extend respectively from said lower ends of said first side walls away from each other, and a protrusion that is disposed between and that is spaced apart from said first side walls, that protrudes downwardly from said top wall of said first lever and that abuts against said punch, said first end of said first lever being pivoted to said first pivot part, said first side walls being opposite to each other in a transverse direction that is perpendicular to the insertion direction and the vertical direction, said top wall covering a top side of said punch and spanning said punch in the transverse direction, said second lever having opposite first and second ends, a top wall that extends from said first end of said second lever to said second end of said second lever, and two second side walls that extend downwardly and respectively from two opposite sides of said top wall of said second lever and that abut respectively against said side flanges for driving rotation of said first lever relative to said first pivot part, said second end of said second lever being pivoted to said second pivot part; and an urging member for urging said punch.

2. The punching device of claim 1, wherein each of said side flanges cooperates with the respective one of said first side walls to form a generally L-shaped structure.

3. The punching device of claim 2, wherein each of said side flanges has an outer end, and extends from said lower end of the respective one of said first side walls to said outer end in the transverse direction, said first lever further having two reinforcing walls that extend downwardly and respectively from said outer ends of said side flanges.

4. The punching device of claim 1, wherein said first pivot part extends upwardly from said first end portion of said punch seat, and said second pivot part extends upwardly from said second end portion of said punch seat.

5. The punching device of claim 1, further comprising first and second pivot shafts, said punch seat being formed with a central hole for extension of said punch therethrough, said central hole being disposed between said first and second end portions of said punch seat, said first and second levers being pivoted to said first and second pivot parts about said first and second pivot shafts, respectively.

6. The punching device of claim 1, wherein said first lever is rotatable relative to said punch seat about a first axis, said second lever being rotatable relative to said punch seat about a second axis that is parallel to said first axis and that is disposed at a level above said first axis.

* * * * *